US011289839B2

(12) United States Patent
Tsou et al.

(10) Patent No.: US 11,289,839 B2
(45) Date of Patent: Mar. 29, 2022

(54) MAIN BOARD AND MEMORY SLOT THEREOF

(71) Applicant: ASUSTEK COMPUTER INC., Taipei (TW)

(72) Inventors: Ping-Han Tsou, Taipei (TW); Li-Chien Wan, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 121 days.

(21) Appl. No.: 16/794,597

(22) Filed: Feb. 19, 2020

(65) Prior Publication Data

US 2020/0274274 A1 Aug. 27, 2020

(30) Foreign Application Priority Data

Feb. 22, 2019 (TW) ..... 108202274

(51) Int. Cl.

| | |
|---|---|
| ***H01R 12/73*** | (2011.01) |
| ***H01R 13/6474*** | (2011.01) |
| ***H01R 12/70*** | (2011.01) |
| ***H01R 13/10*** | (2006.01) |

(52) U.S. Cl.

CPC ..... *H01R 12/737* (2013.01); *H01R 12/7076* (2013.01); *H01R 13/10* (2013.01); *H01R 13/6474* (2013.01)

(58) Field of Classification Search

CPC ..... H01R 33/92; H01R 33/88; H01R 9/2458; H01R 25/006; H01R 25/161; H01R 31/02; H01R 31/005; H01R 12/7082; H01R 12/585; H01R 13/6474; H01R 13/10; H01R 12/7076; H01R 12/737; G11C 5/06

See application file for complete search history.

(56) References Cited

U.S. PATENT DOCUMENTS 6,833,618 B2 * 12/2004 Ono ..... H01L 25/065 257/726
9,773,528 B1 * 9/2017 Ding ..... H01R 12/735

FOREIGN PATENT DOCUMENTS

CN 201000940 Y 1/2008

* cited by examiner

*Primary Examiner* — Renee S Luebke
*Assistant Examiner* — Paul D Baillargeon
(74) *Attorney, Agent, or Firm* — Muncy, Geissler, Olds & Lowe, P.C.

(57) ABSTRACT

A memory slot adapted to dispose on a circuit board is provided. The memory slot includes a slot body and a plurality of pins. The slot body includes N connecting parts for configuring to M memory cards. The plurality of pins are disposed in the slot body for electrically connecting the M memory cards to the circuit board. Each pin includes O branches extending to the connecting parts respectively for electrically connecting corresponding golden fingers of the memory cards. Where the N, M and O are greater than or equal to 2. The disclosure further provides a main board with the memory slot.

12 Claims, 5 Drawing Sheets

MAIN BOARD AND MEMORY SLOT THEREOF

CROSS-REFERENCE TO RELATED APPLICATION

This application claims the priority benefit of Taiwan Application Serial No. 108202274, filed on Feb. 22, 2019. The entirety of the above-mentioned patent application is hereby incorporated by reference herein and made a part of specification.

BACKGROUND OF THE INVENTION

Field of the Invention

The disclosure relates to a main board, and in particular, to a memory slot of the main board.

Description of the Related Art

In general, in a circuit layout for memories on a main board, a number of memory slots disposed on a circuit board is determined based on a number of memory channels supported by a memory controller in a central processing unit (CPU).

If a large memory capacity is required, the circuit layout is usually performed through two dual in-line memory modules per channel (Two DIMM per channel). However, a density of a trace on the circuit board is increased in this way, not only the difficulty of the circuit layout is increased with a redundant signal loss, but also the costs for a printed circuit board is raised.

BRIEF SUMMARY OF THE INVENTION

The disclosure provides a memory slot disposed on a circuit board. The memory slot includes a slot body and a plurality of pins. The slot body includes N connecting parts for configuring M memory cards. The plurality of pins are disposed in the slot body for electrically connecting the memory cards to the circuit board. Each pin includes O branches extending to the N connecting parts respectively for electrically connecting corresponding golden fingers of the memory cards. N, M and O are greater than or equal to 2.

The disclosure further provides a main board. The main board includes a circuit board, a central processing unit socket, and a memory slot. The central processing unit socket is disposed on the circuit board. The memory slot is disposed on the circuit board. The memory slot includes a slot body and a plurality of pins. The slot body includes N connecting parts for configuring to M memory cards. The plurality of pins are disposed in the slot body for electrically connecting the memory cards to the circuit board. Each pin includes O branches extending to the connecting parts respectively for electrically connecting corresponding golden fingers of the memory cards. N, M and O are greater than or equal to 2.

The two memory slots of the disclosure accommodate a plurality of memory cards simultaneously, and the internal pins are arranged in parallel to simplify the circuit layout on the circuit board, thereby resolving problems derived from a conventional memory slot.

Specific embodiments used in disclosure are further described using the following embodiments and drawings.

DETAILED DESCRIPTION OF THE EMBODIMENTS

Specific embodiments of the disclosure are described in more detail below with reference to the schematic diagrams. Advantages and features of the disclosure will be clearer based on the following descriptions and claims. It is to be noted that all the drawings are in a very simple form and in an inaccurate proportion, and are merely intended to aid in illustrating a purpose of embodiments of the disclosure conveniently and clearly.

Figure 1:
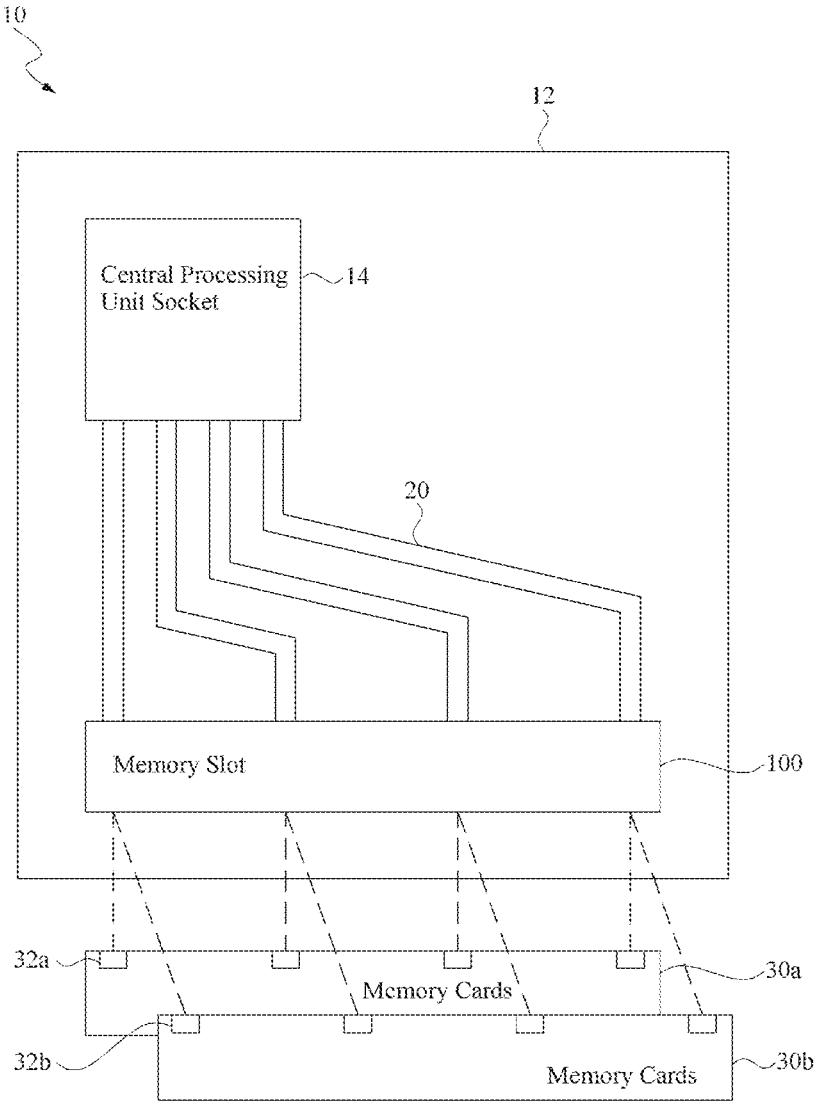
FIG. 1 is a schematic block diagram of an embodiment of a main board according to the disclosure.

Referring to FIG. 1, FIG. 1 is a schematic block diagram of an embodiment of a main board 10 according to the disclosure. As shown in the figure, the main board 10 includes a circuit board 12, a central processing unit socket 14, and a memory slot 100. The central processing unit socket 14 is disposed on the circuit board 12 and configures for a central processing unit (not shown). The memory slot 100 is disposed on the circuit board 12 and configures at least two memory cards 30*a*, 30*b* (where two memory cards are used as an example in the figure). The memory cards 30*a*, 30*b* include a plurality of golden fingers 32*a*, 32*b* to electrically connect to the memory slot 100. The central processing unit socket 14 electrically connects to the memory slot 100 through a trace 20 disposed on the circuit board 12.

In an embodiment, the memory card configuring to the memory slot 100 is a dual in-line memory module (DIMM) card. However, the disclosure is not limited thereto. In an embodiment, the main board 10 employs a configuration mode of two dual in-line memory modules per channel, and the memory slot 100 is corresponding to a single channel. Therefore, the main board supports two memory cards by using only one memory slot 100. However, the disclosure is not limited thereto. In other embodiments, based on a number of memory channels that a memory controller inside the central processing unit supports and actual use requirements, the main board employs a dual-channel memory configuration mode. Each channel is not limited to supporting only a dual memory card, and the memory slot is not limited to supporting only one single channel.

Figure 2:
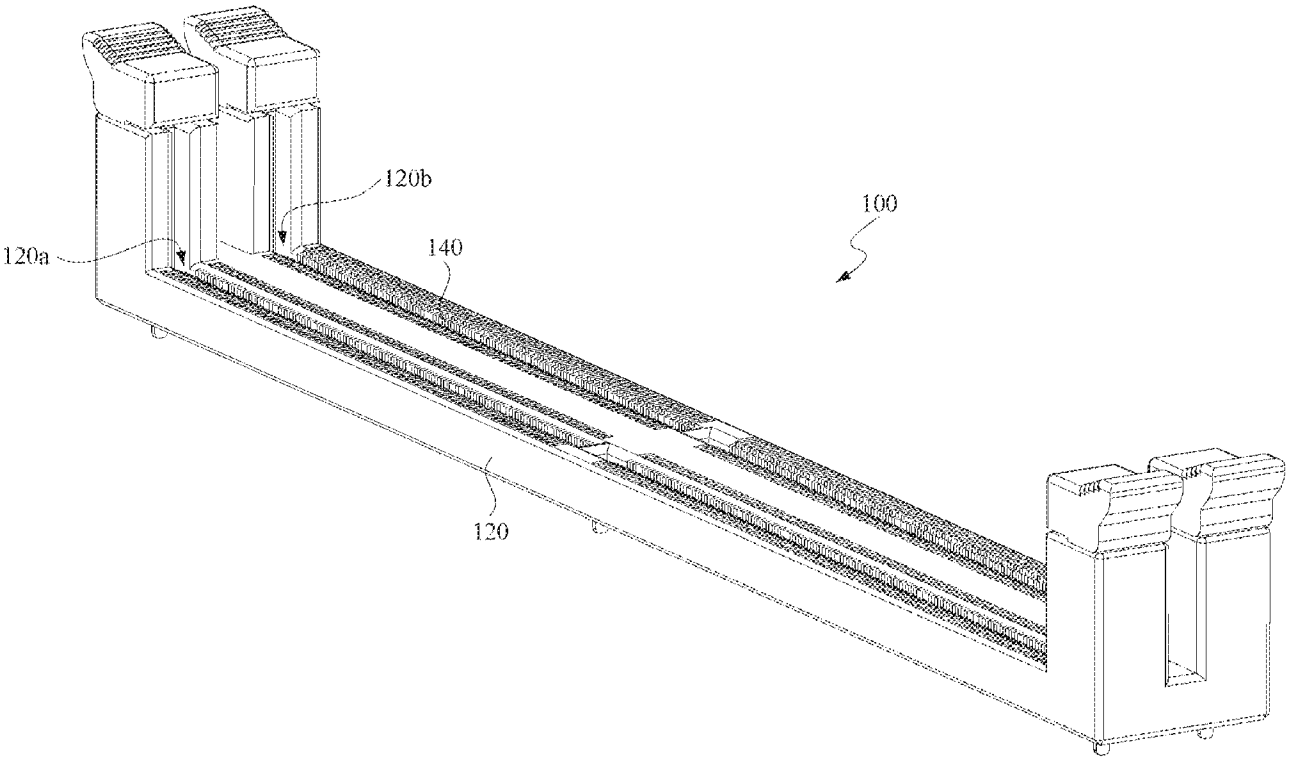
FIG. 2 is a schematic three-dimensional diagram of an embodiment of a memory slot in FIG. 1.
Figure 3:
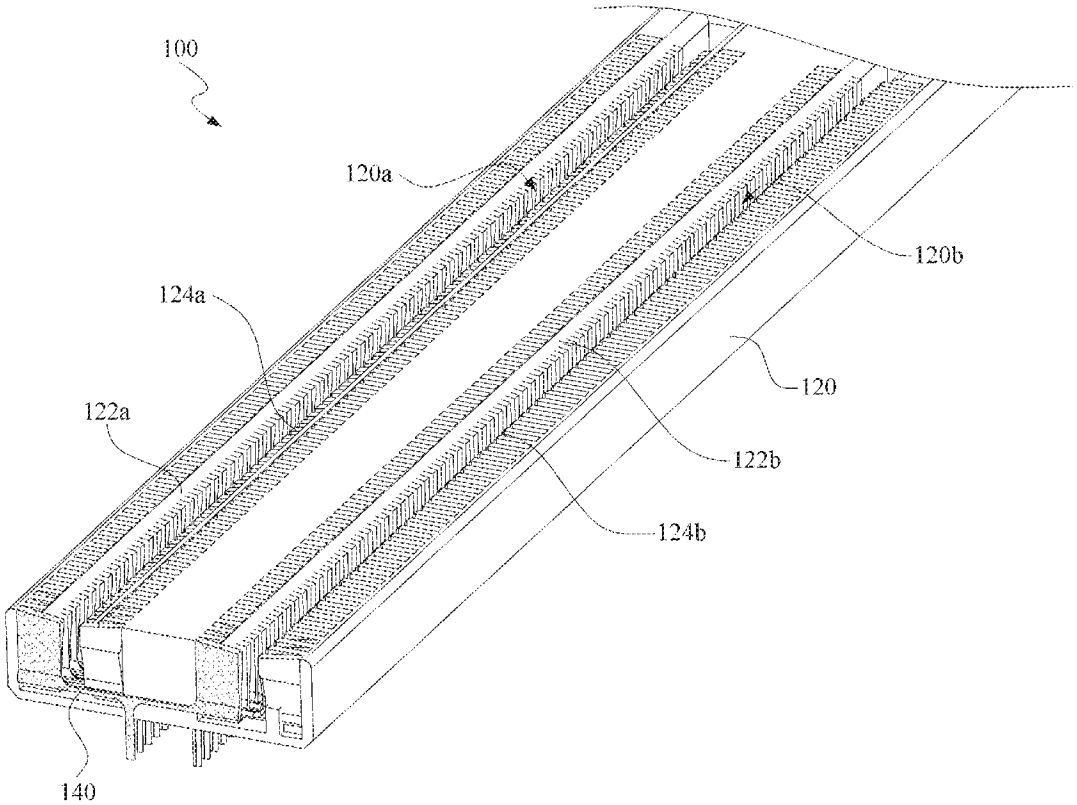
FIG. 3 is a schematic profile diagram of an embodiment of a memory slot in FIG. 1.
Figure 4:
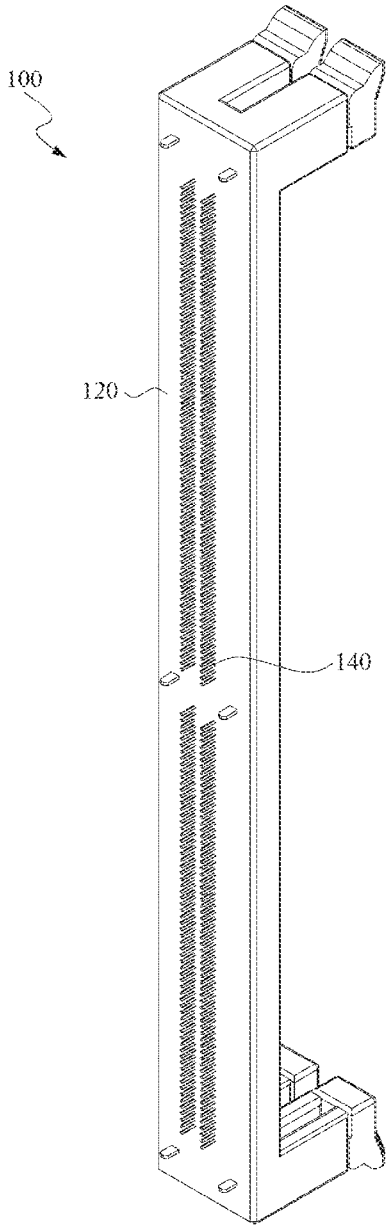
FIG. 4 is a schematic bottom diagram of an embodiment of a memory slot in FIG. 1.

Referring to the FIG. 2 to FIG. 4, FIG. 2 is a schematic three-dimensional diagram of an embodiment of the memory slot 100 in FIG. 1, FIG. 3 is a schematic profile diagram of an embodiment of the memory slot 100 in FIG. 1, and FIG. 4 is a schematic bottom diagram of an embodiment of the memory slot 100 in FIG. 1.

As shown in the figure, the memory slot 100 includes a slot body 120 and a plurality of pins 140. A number of the pins 140 is determined based on a specification of the memory cards (that is, a number of golden fingers). The slot body 120 includes N connecting parts 120*a*, 120*b* for configuring memory cards. In this embodiment, N and M are equal to 2. In other words, the memory slot 100 in this embodiment includes two connecting parts 120*a*, 120*b* for supporting two memory cards, and the connecting parts 120*a*, 120*b* are corresponding to the same channel. However, the disclosure is not limited thereto. If a single channel is required to support more memory cards, the foregoing number N and M are also integers greater than 2. In other words, more connecting parts are disposed on the slot body 120.

The connecting part of the memory slot 100 (the connecting part 120*a* is used as an example) includes two side walls 122*a*, 124*a* facing two opposite side faces of the memory card. The pins 140 are disposed in the slot body 120 for electrically connecting the two memory cards to the circuit board 12 located under the memory slot 100. In an embodiment, as shown by points in FIG. 3, the pins 140 extend upward to the two connecting parts 120*a*, 120*b* for electrically connecting the two memory cards to the circuit board 12 located under the memory slot 100.

Figure 5:
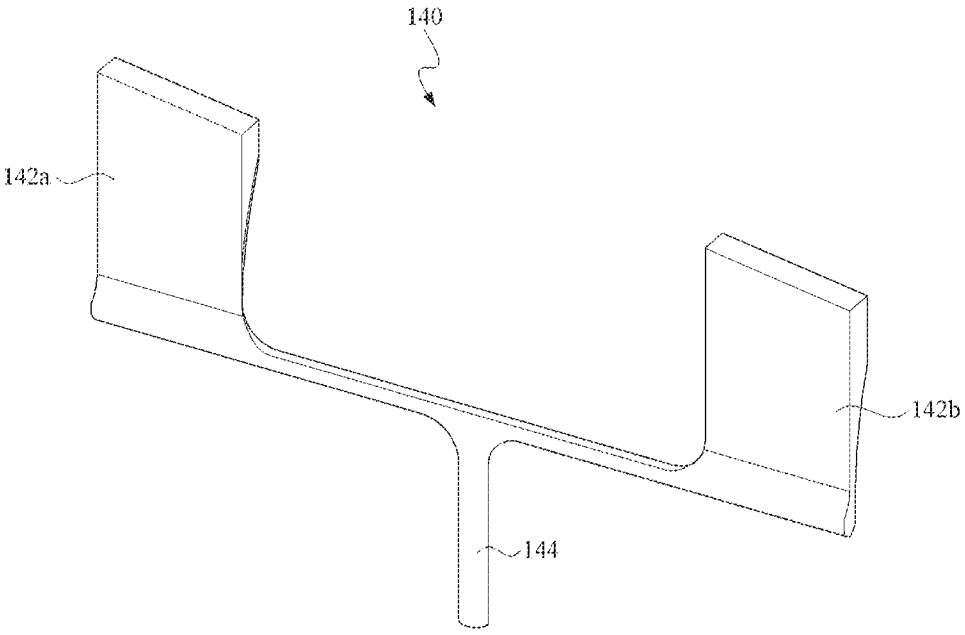
FIG. 5 is a schematic enlarged diagram of a pin in FIG. 3.

Referring to FIG. 5, FIG. 5 is a schematic enlarged diagram of the pin in FIG. 3. In terms of a structural design of the pin 140, as shown in the figure, in an embodiment, the pin 140 is a T-shaped pin, and an upper portion of the pin includes O branches 142*a*, 142*b* (in the embodiment, O is equal to 2) extending to the corresponding side walls of the connecting parts 120*a*, 120*b* respectively, that is, side walls 122*a* and 122*b* or side walls 124*a* and 124*b* for electrically connecting corresponding golden fingers of the two memory cards. A lower portion of the pin 140 is a thrusting needle 144 to fix on the circuit board 12.

In an embodiment, the thrusting needle 144 is fixed on the circuit board 12 through welding, tin plating, or the like, and is electrically connected to a trace on the circuit board 12. This pin 140 constitutes a T-topology circuit layout, so that the two memory cards are in a parallel connection on the trace on the circuit board 12. In this way, the trace on the circuit board 12 is simplified, to reduce costs for the circuit board 12.

In order to transfer a signal efficiently, in an embodiment, the two branches 142*a*, 142*b* on the upper portion of the pin 140 are designed to include the same impedance to avoid a reflection and reduce a signal loss. In an embodiment of FIG. 5, the upper portion of the pin 140 includes two branches 142*a*, 142*b* for connecting the corresponding gold fingers of the two memory cards. However, the disclosure is not limited thereto. Based on a number of memory cards supported by a single channel, more branches extending to connect corresponding golden fingers of these memory cards are formed on the upper portion of the pin. Also, in an embodiment, the branches on the upper portion of the pin are designed to include the same impedance to avoid a reflection.

In this embodiment, all the pins 140 disposed in the memory slot 100 are T-shaped pins. A number of the pins 140 is equal to a number of golden fingers of a single memory card instead of a sum of numbers of the golden fingers of the two memory cards that are disposed in the memory slot 100. In this way, the circuit layout on the circuit board 12 is simplified, to reduce layout difficulty and costs for the circuit board 12. However, the disclosure is not limited thereto. In an embodiment, the memory slot also uses a mixture of the pin 140 provided in the disclosure and a conventional pin according to actual use requirements. This setting mode helps reduce a density of the trace on the circuit board to a certain extent, so as to reduce the difficulty of the circuit layout.

The two memory slots of the disclosure accommodate a plurality of memory cards simultaneously, and the internal pins are arranged in parallel to simplify the circuit layout on the circuit board, thereby resolving problems derived from a conventional memory slot.

The foregoing descriptions are merely preferred embodiments of the disclosure, but do not impose any limitation on the disclosure. Any form of change such as an equivalent replacement or modification made by any person skilled in the art to the technical means and the technical content provided in the disclosure without departing from scope of the technical means of the disclosure is a content that does not deviate from the technical means of the disclosure, and still falls within protection scope of the disclosure.

The invention claimed is:

1. A memory slot, adapted to be disposed on a circuit board, the memory slot comprising:

a slot body having N connecting parts for configuring M memory cards; and a plurality of pins disposed in the slot body for electrically connecting the memory cards to the circuit board, wherein, each pin comprises 0 branches extending to each of the connecting parts respectively for electrically connecting corresponding golden fingers of the memory cards;

wherein, N, M and O are greater than or equal to 2; and wherein the pin is a T-shaped pin.

2. The memory slot according to claim 1, wherein each of the branches has the same impedance.

3. The memory slot according to claim 1, wherein a number of the pins is equal to a number of the golden fingers of the memory card.

4. The memory slot according to claim 1, wherein the memory card is a DIMM memory card.

5. The memory slot according to claim 1, wherein the connecting part comprises two side walls facing two opposite side faces of the memory card, and each of the branches of the pin extends to the corresponding side walls of the connecting parts.

6. The memory slot according to claim 1, wherein each of the connecting parts is corresponding to the same channel.

7. A main board, comprising:

a circuit board;

a central processing unit socket, disposed on the circuit board;

a memory slot, disposed on the circuit board, the memory slot comprising:

a slot body, comprising N connecting parts for configuring to M memory cards; and a plurality of pins, disposed in the slot body for electrically connecting the memory cards to the circuit board, wherein, each pin comprises 0 branches extending to the connecting parts respectively for electrically connecting corresponding golden fingers of the memory cards;

wherein, N, M and O are greater than or equal to 2; and wherein the pin is a T-shaped pin.

8. The main board according to claim 7, wherein each of the branches has the same impedance.

9. The main board according to claim 7, wherein a number of the pins is equal to a number of the golden fingers of the memory card.

10. The main board according to claim 7, wherein the memory card is a DIMM memory card.

11. The main board according to claim 7, wherein the connecting part comprises two side walls facing two opposite side faces of the memory card, and each of the branches of the pin extends to the corresponding side walls of the connecting parts.

12. The main board according to claim 7, wherein the connecting parts are corresponding to the same channel.

* * * * *